United States Patent [19]

Meyer et al.

[11] 4,265,047

[45] May 5, 1981

[54] VEHICLE INSTRUMENTATION AND CONTROL APPARATUS

[75] Inventors: Burton C. Meyer, Downers Grove; Howard J. Morrison, Deerfield; Gunars Licitis, Jr., Lombard, all of Ill.

[73] Assignee: Marvin Glass & Associates, Chicago, Ill.

[21] Appl. No.: 10,808

[22] Filed: Feb. 9, 1979

[51] Int. Cl.[3] ..... A63H 33/26

[52] U.S. Cl. ..... 46/232; 46/1 B

[58] Field of Search ..... 35/11 R, 12 Q; 46/1 B, 46/175 AR, 177, 232; 273/1 R, 1 E

[56] References Cited

U.S. PATENT DOCUMENTS

| | | | |
|---|---|---|---|
| 2,700,227 | 1/1955 | Arkell et al. | 35/11 R |
| 2,715,783 | 8/1955 | Chedister et al. | 35/11 R |
| 3,108,384 | 10/1963 | Jazbutis et al. | 35/11 R |
| 3,154,864 | 11/1964 | Jazbutis | 35/11 R |
| 3,231,988 | 2/1966 | Freyde | 35/11 R |
| 3,391,489 | 7/1968 | Lohr et al. | 46/232 |
| 3,478,442 | 11/1969 | Jazbutis et al. | 35/11 R |
| 3,735,529 | 5/1973 | Roslen | 46/232 |

*Primary Examiner*—William H. Grieb

*Attorney, Agent, or Firm*—Mason, Kolehmainen, Rathburn & Wyss

[57] ABSTRACT

A simulated vehicle instrumentation and control apparatus includes sound effects generating arrangements, indicators and displays that are controlled to simulate realistic driving conditions in response to the operation of various vehicle controls by the operator of the simulated vehicle apparatus. The vehicle controls include a steering wheel, an accelerator pedal, a brake pedal, a transmission gear shift selector, and an ignition switch. In various specific embodiments, additional controls are provided including siren and light controls. The turning of an ignition key in the ignition switch to a predetermined position initiates operation of the simulated vehicle apparatus. Operation of the accelerator pedal conditions the simulated vehicle apparatus to generate simulated vehicle engine sound effects in response to subsequent operation of the transmission gear shift selector. Operation of the brake pedal conditions the vehicle apparatus to generate simulated tire and brake squealing for a predetermined time interval. Turning of the steering wheel to either the left or right beyond predetermined limits conditions the vehicle apparatus to generate an out-of-control squealing effect for a predetermined time interval. In specific arrangements various other displays and indicators are provided that are actuated in response to operation of the controls.

10 Claims, 10 Drawing Figures

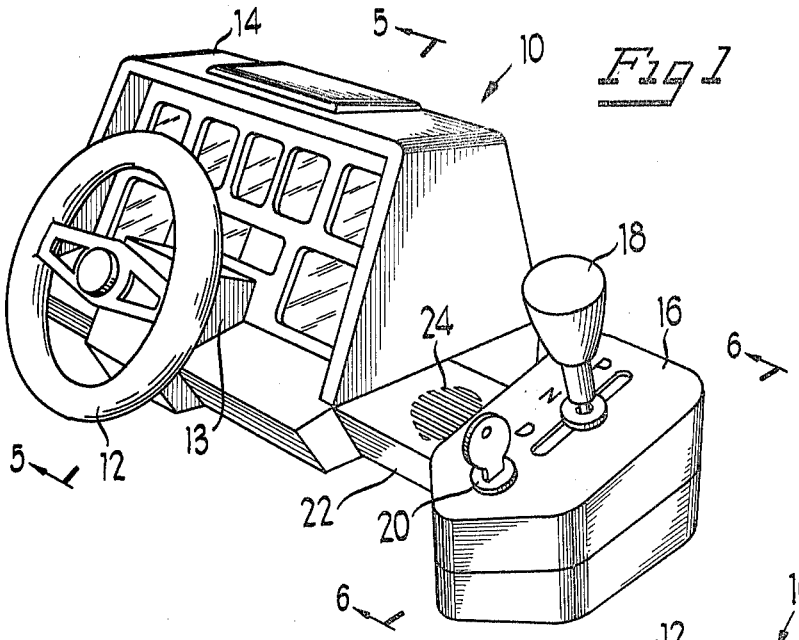
Fig 1
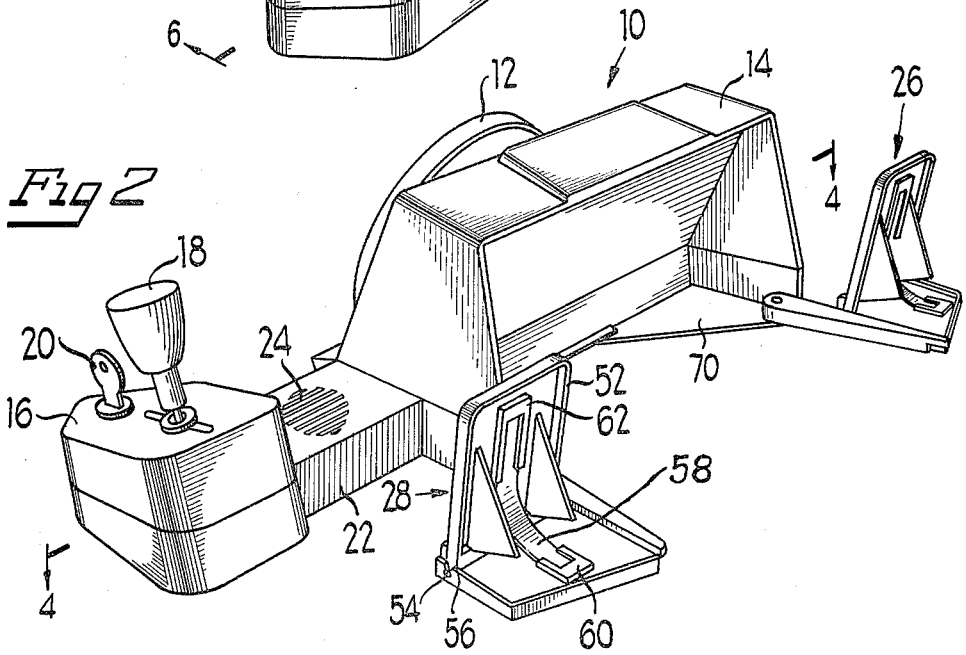
Fig 2
Fig 3
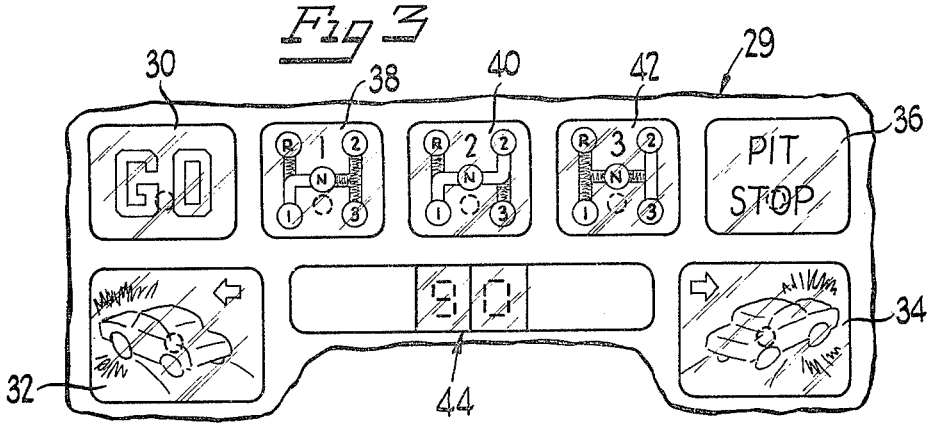

Fig 5
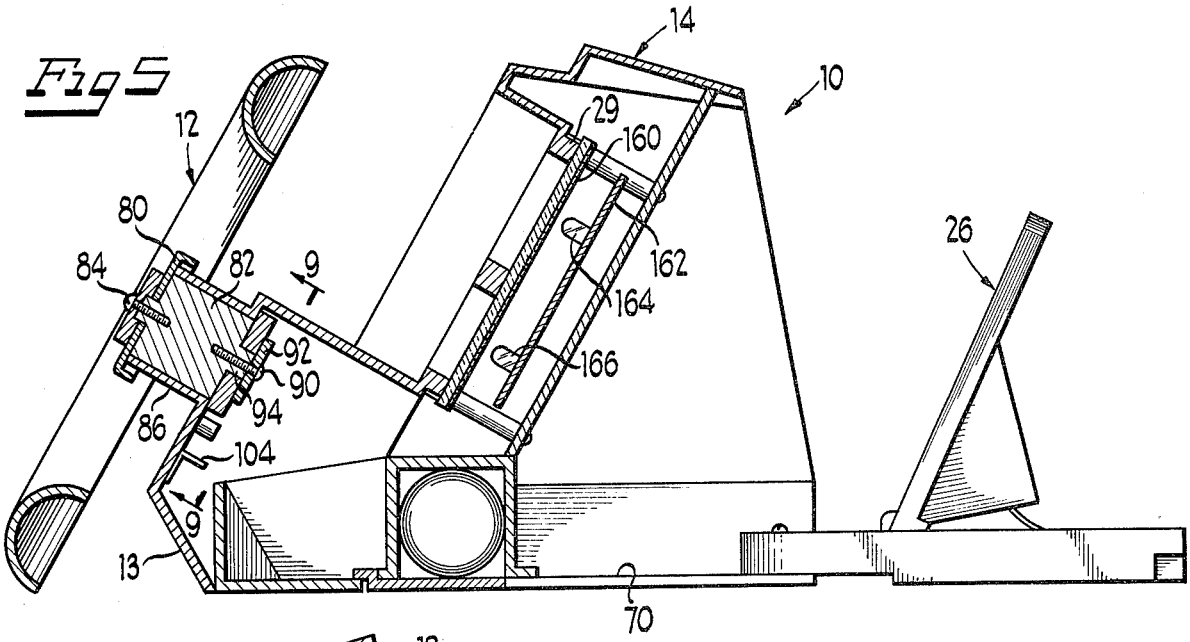
Fig 6
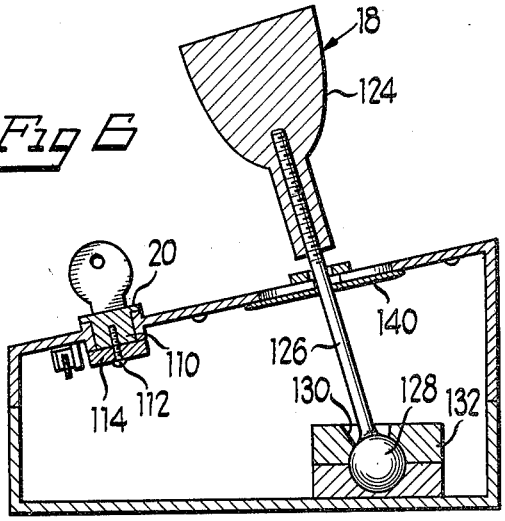
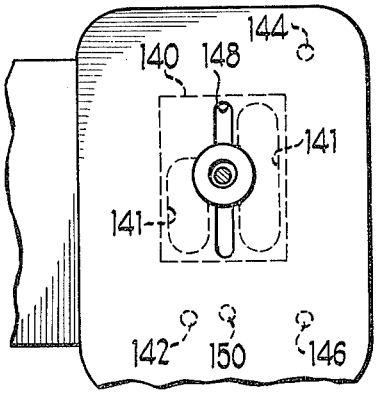
Fig 7
Fig 8
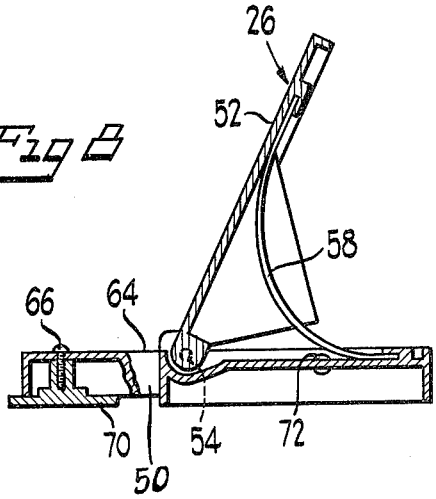
Fig 9
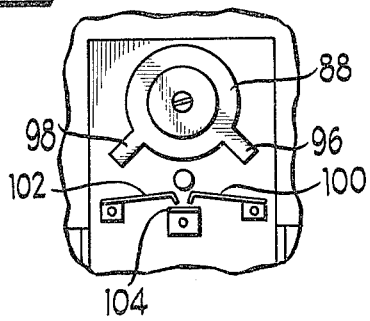

VEHICLE INSTRUMENTATION AND CONTROL APPARATUS

BACKGROUND OF THE INVENTION

1. Field of the Invention

The present invention relates generally to game and training apparatus and more particularly to a simulated vehicle instrumentation and control apparatus including various operator controls and arrangements to simulate vehicle sounds and operation responsive to the vehicle controls.

2. DESCRIPTION OF THE PRIOR ART

There are various simulated vehicle and simulated vehicle control arrangements utilized as entertaining game apparatus and/or training apparatus. For example, simulated vehicles with steering wheels and horns are provided on small scale vehicles for children to ride or operate either manually by the provision of pedals and mechanical drive arrangements or by motors; electric, gasoline, etc. Further, simulated vehicle instrumentation and control apparatus exist in the form of a dashboard with an instrument panel, steering wheel and the like for the entertainment of children.

However, there is a constant need for new and improved game apparatus and training arrangements which are operable by children, interesting to children and that involve controls and sound effect arrangements more realistically simulating the operation of a vehicle.

SUMMARY OF THE INVENTION

Accordingly, it is a principal object of the present invention to provide a simulated vehicle instrumentation and control game apparatus that includes operator controls and arrangements to generate vehicle sound effects and instrument indications in response to operation of the controls to more realistically simulate the operation and provide entertainment and training to the user.

The present invention provides a new and improved simulated vehicle instrumentation and control game apparatus including sound effects generating arrangements, indicators and displays that are controlled to simulate realistic driving conditions in response to the operation of various vehicle controls by the operator of the simulated vehicle apparatus. The vehicle controls include a steering wheel, an accelerator pedal, a brake pedal, a transmission gear shift selector, and an ignition switch. In various specific embodiments, additional controls are provided including siren and light controls. The turning of an ignition key in the ignition switch to a predetermined position initiates operation of the simulated vehicle apparatus. Operation of the accelerator pedal conditions the simulated vehicle apparatus to generate simulated vehicle engine sound effects in response to subsequent operation of the transmission gear shift selector. Operation of the brake pedal conditions the vehicle apparatus to generate simulated tire and brake squealing for a predetermined time interval. Turning of the steering wheel to either the left or right beyond predetermined limits conditions the vehicle apparatus to generate an out-of-control squealing effect for a predetermined time interval. In specific arrangements various other displays and indicators are provided that are actuated in response to operation of the controls.

BRIEF DESCRIPTION OF THE DRAWINGS

FIG. 1 is a front perspective view of a simulated vehicle instrumentation and control apparatus constructed in accordance with the principles of the present invention;

FIG. 2 is a rear perspective view of the simulated vehicle instrumentation control apparatus of FIG. 1.

FIG. 3 is an enlarged, fragmentary elevational view of the instrument panel of the apparatus of FIG. 1 and illustrating various indicators and displays that are provided in various specific embodiments of the present invention;

FIG. 5 is an enlarged view partly in section and taken generally along the line 5—5 of FIG. 1;

FIG. 6 is an enlarged sectional view taken along the line 6—6 of FIG. 1;

FIG. 7 is an enlarged fragmentary top elevational view partly in section of the vehicle apparatus of FIG. 1 and illustrating details of the transmission gear shift selector arrangement;

FIG. 8 is a sectional view of the vehicle apparatus of FIG. 4 taken generally along the line 8—8 of FIG. 4 and illustrating details of the brake control arrangement of the present invention;

FIG. 9 is a fragmentary, enlarged elevational view with parts broken away, taken generally from the line 9—9 of FIG. 5 and illustrating the details of the steering control arrangement of the present invention.

DESCRIPTION OF THE PREFERRED EMBODIMENT

Figure 4:
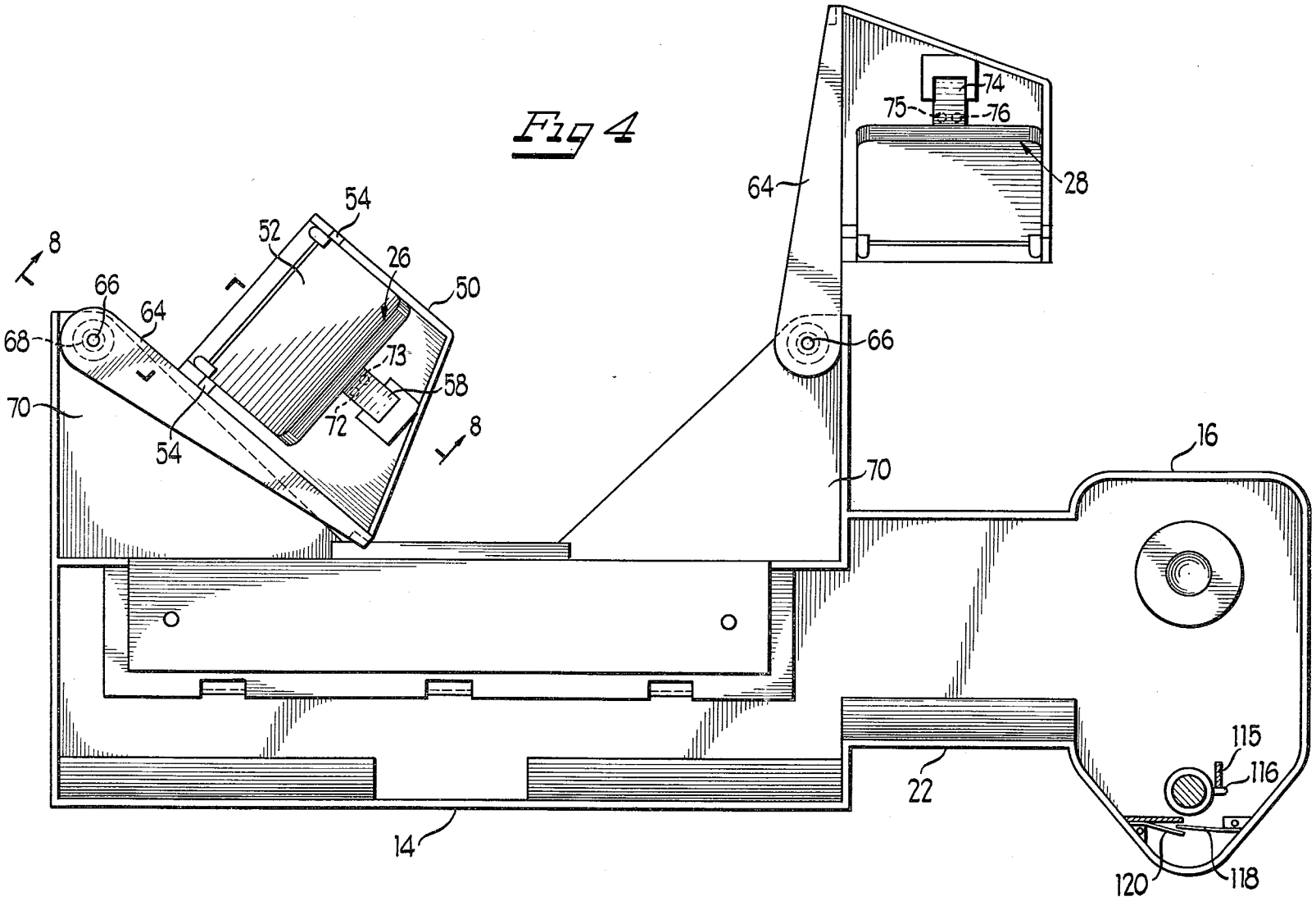
FIG. 4 is an enlarged top elevational view partly in section and taken generally along the line 4—4 of FIG. 2.

Referring now to FIGS. 1 and 2, a simulated vehicle instrumentation and control apparatus constructed in accordance with the principles of the present invention is generally designated 10 and includes various operator controls. A steering wheel 12 is rotatably mounted in a centrally located housing portion 13 of an instrument panel and dashboard vehicle housing section 14 of the simulated vehicle apparatus 10. A console vehicle housing section 16 of the simulated vehicle apparatus 10 includes a transmission gear shift selector control 18 and an ignition switch arrangement 20. The console vehicle housing section 16 is connected to the dashboard-instrument vehicle housing panel section 14 by a vehicle housing panel section 22. The instrument and dashboard section 14, the console section 16 and the vehicle adjoining panel section 22 are rigidly joined to form an overall housing of the vehicle apparatus 10 in accordance with suitable fastening techniques. In a specific embodiment, the sections 14, 16 and 22 are molded as a one-piece housing in a single operation.

The instrument and dashboard housing section 14 includes display window portions associated with a corresponding number of instrument indicators and displays in accordance with various specific embodiments of the present invention. The various indicators are actuated to illuminate the associated displays in response to operation of the operator controls including the steering wheel 12, the ignition switch 20, and the transmission gear shift selector 18. A speaker grill array 24 is provided in the vehicle adjoining panel section 22 for cooperation with an internally mounted speaker discussed hereinafter that emits vehicle sound effects generated by the vehicle apparatus 10 in response to operation of the various controls.

The vehicle apparatus 10 further includes a brake pedal control 26 and an accelerator pedal control 28 each of which is pivotally attached to the vehicle apparatus 10. The brake pedal control 26 and the accelerator control 28 are pivotable between an inward storage position for compact storage of the vehicle apparatus 10 and an outward operating position. Additionally the pivoting movement of the controls 26 and 28 provides a range of operator adjustment for vehicle operators of varying heights and proportions.

The operator of the vehicle apparatus 10 assumes a generally seated position in front of the steering wheel 12 and the instrument and dashboard housing section 14 with the left leg positioned near the brake pedal control 26 of the left side of the vehicle apparatus 10. The right leg of the operator straddles the vehicle adjoining panel section 22 and is positioned near the accelerator pedal control 28. The right hand of the operator is then utilized for the operation of the transmission gear shift selector 18 and the ignition switch 20.

In operation, the vehicle operator turns the ignition switch control 20 to the on position and the internal control arrangements of the vehicle apparatus 10 indicates the ready state of the vehicle apparatus 10 by means of the indicators and displays on a display panel 29 of the instrument and dashboard section 14.

Referring now to FIG. 3, a "GO" indicator 30 is actuated upon operation of the ignition switch 20. The "GO" indicator 30 informs the operator that simulated drive operation of the vehicle may now proceed. At this point, the operator positions the transmission gear shift selector control 18 from a park or neutral position to a drive position and depresses the accelerator pedal control 28. In response to the transmission gear shift selector control 18 being in the drive position and upon actuation of the accelerator pedal control 28, the internal control arrangement of the vehicle apparatus 10 generates simulated engine and vehicle sounds of a vehicle moving from a standing position and shifting through the gears of a transmission to higher speed operation. In the specific embodiment illustrated in FIGS. 1 and 2, a simulated automatic transmission gear shift selector control 18 is provided with shifting operation between the park and drive positions. However, in other specific embodiments the use of a manual transmission gear shift selector is provided to allow shifting by the operator through three or more forward gears.

During the simulated vehicle operation, the operator also maneuvers the steering wheel 12 to simulate the steering of a vehicle. If the operator turns the steering wheel 12 past a predetermined position either to the right or the left from a predetermined center position, the internal control arrangement of the vehicle apparatus 10 generates a brake and/or tire squealing sound effect. Further, if the operator depresses the brake pedal control 26, a brake and/or tire squealing sound effect is generated. When the brake and/or squealing sound effect is generated in response to the operation of the steering wheel 12, one of two crash indicators 32, 34 is actuated to indicate a crash caused by turning the steering wheel 12 too far to the left or right respectively. In a specific embodiment, a pit-stop indicator 36 is provided that is actuated either by a predetermined elapsed driving time period, inappropriate operation of the various controls or to indicate a crash upon the operation of the brake pedal 26 in various specific embodiments.

Further, in other specific embodiments, three gear shifting indicators 38, 40 and 42 are provided for use with a manual transmission gear selector control 18 to inform the operator when to shift gears or in another specific embodiment to indicate the gear of operation. A speedometer or score indicator 44 is provided in various specific embodiments denoting either skill of the operator in the operation of the controls, elapsed driving time or simulated speed of the vehicle as the driving period progresses.

Considering now the details of the simulated vehicle instrumentation and control apparatus of the present invention, and referring additionally now to FIGS. 4–9, the brake pedal control 26 includes a base portion 50 and a brake pedal 52 pivotally mounted to the base portion 50 by means of extending pivot pins 54 interfitting with slotted portions 56 of the base portion 50. A planar strip spring 58 is positioned between a first spring retainer 60 on the base portion 50 and a second spring retainer 62 on the brake pedal 52. The spring 58 biases the brake pedal 52 to an upper, non-operated position.

The base portion 50 of the brake pedal control 26 includes an extending arm 64 pivotally mounted on the instrument panel and dashboard housing section 14 by means of a fastener 66 passing through a hole in the arm 64 and being received within a threaded sleeve portion 68 of a base portion 70 of the instrument and dashboard housing section 14. Two switch contacts 72, 73 are carried by the base portion 50 and positioned to be contacted upon actuation of the brake pedal 52 to a predetermined operating point to complete an electrical circuit as will be explained in detail hereinafter.

The accelerator pedal control 28 is identical to the brake pedal control 26 except that the accelerator pedal control 28 is constructed as a mirror image having a reverse orientation as that of the brake pedal control 26. The accelerator pedal control 28 includes a spring element 74 and switch contacts 75, 76. The remaining structure of the accelerator pedal control 28 is identical to that of the brake pedal control 26 and represented with identical reference numerals in the drawings.

As best seen in FIG. 5, the steering wheel 12 includes a hub portion 80 fixedly attached to a cylindrical steering column portion 82 by means of a fastener 84 passing through a hole in the hub portion 80 and received within a threaded sleeve of the steering column 82. The steering column 82 is rotatably mounted within a hollow steering column housing 86 extending from the section 13 of the instrument panel and dashboard housing section 14.

Internal to the instrument panel and dashboard housing section 14 and referring additionally now to FIG. 9, a ring shaped switch actuator 88 is fixedly attached to the bottom base portion of the steering column 82 by means of a fastener 90 and a mounting disc 92. The mounting disc 92 contacts the switch actuator 88 and the fastener 90 is received within a threaded sleeve portion of the steering column 82. The switch actuator 88 is positioned over an extending boss portion 94 of the steering column 82. As best seen in FIG. 9, the switch actuator 88 includes two extending arms 96, 98 spaced around the switch actuator 88 and arranged upon rotation of the steering wheel 12 to contact movable switch arms 100, 102 respectively. The movable switch arms 100, 102 are mounted on the inside of the instrument panel and dashboard housing section 14.

Upon being contacted by the actuator arms 96, 98 the respective movable switch arms 100, 102 are deflected to contact a fixed switch contact 104 also mounted on the instrument panel and housing section 14. The actuator arm 96 contacts the movable switch arm 100 upon rotation of the steering wheel to the left to form an electrical circuit path between the switch contact elements 100, 104. Correspondingly, the actuator arm 98 upon rotation of the steering wheel 12 to the right results in an electrical circuit path being established between the movable switch arm 102 and the switch contact 104 as will be explained in detail hereinafter.

Referring now to FIGS. 4 and 6, the ignition switch 20 is rotatably mounted within a receiving sleeve 110 of the console housing section 16. The ignition switch 20 is positioned by a fastener 112 and a mounting disc 114. The mounting disc 114 is positioned on the bottom of the ignition switch 20 inside of the instrument panel and dashboard housing section 14. The fastener 112 is positioned through a hole in the mounting disc 114 into a threaded sleeve portion of the ignition switch 20. The mounting disc 114 includes an extending switch actuator arm 116 movable between a stop limit tab 115 and an actuating position. The switch actuator arm 116 upon rotation of the ignition switch 20 from the off position of FIGS. 1 and 4 is rotated approximately 90° C. to displace a movable switch contact arm 118 affixed to the housing section 16. Upon being displaced, the movable switch contact arm 118 contacts a fixed switch contact arm 120 affixed to the housing section 16 to establish an electrical circuit path denoting the on ignition position as will be explained in detail hereinafter.

The transmission gear shift selector 18, as best seen in FIGS. 4, 6 and 7, includes a gear shift knob 124 and an elongated gear shift rod 126 including a threaded end portion received within a threaded sleeve of the gear shift knob 124. The other end of the gear shift rod 126 includes an enlarged spherical portion 128 rotatably mounted in a receiving socket 130 of a housing portion 132 of the console housing section 16. In one specific embodiment utilizing an automatic transmission gear selector 18, the gear shift rod 126 is pivotally mounted to the housing section 16 to allow linear movement of the gear shift selector along the park to drive shifting path. Considering the specific embodiment of a manual gear shift selector 18, the three gear shift position slotted arrangement shown in phantom and referred to at 141 in FIG. 7 is provided in the console housing section 16 and disposed about the gear shift rod 126. In the specific embodiment illustrated in FIGS. 1, 2 and 7 for an automatic transmission gear shift selector 18, a lineal, slotted arrangement 148 is provided in the console housing 16.

As best seen in FIG. 7, a gear shift selector contact plate 140 is fixedly attached to the gear shift rod 126 by a set screw, glue, etc. The switch contact 140 is fabricated from an electrically conductive material in one specific embodiment and contacts a fixed switch contact 150 to provide an electrical path upon positioning of the automatic gear shift selector rod 126 from the park "P" to the drive "D" positions.

Considering again the specific embodiment providing a manual gear shift selector control 18, movement of the gear shift rod 126 with attached contact plate 140 provides an electrical contact with a first fixed switch contact 142 in a first gear position, an electrical contact with a second fixed switch contact 144 in a second gear position and an electrical contact with a third fixed switch contact 146 in a third gear position. The selective electrical contacts provided by the contact plate 140 and the switch contacts 142, 144 and 146 are utilized by the control circuitry of the vehicle apparatus 10 to determine the position of the transmission gear shift selector control 18 during operation as will be explained in detail hereinafter. In other specific embodiments utilizing an automatic transmission gear shift selector control 18, a switch actuator may be provided on the gear shift rod 126 to cause actuation of a switch arrangement mounted within the console housing section 16. Concerning the switch contacts 142, 144 and 146 and the contact plate 140, in a specific embodiment push-button switches are provided at the switch locations 142, 144 and 146 and the plate 140 need not be fabricated from a conductive material but utilized only as an actuator plate.

Referring now to FIG. 5, the display panel 29 with suitably arranged openings for the various displays 30 through 44 of FIG. 3 is formed within the front portion of the instrument panel and dashboard housing section 14. A bezel 160 is positioned behind the instrument panel array 29 and includes the various indicia, displays and diagrammatic representations corresponding to the desired specific indicators to be utilized such as the indicators and displays 30 through 44 illustrated in FIG. 3. A mounting board 162 is positioned behind the bezel 160 and includes the various display actuating components and illumination sources; e.g. LED's or lamps with the appropriate indicators and displays being illuminated through the bezel 160. The illumination sources on the mounting board 162 are represented by illumination sources 164, 166.

Figure 10:
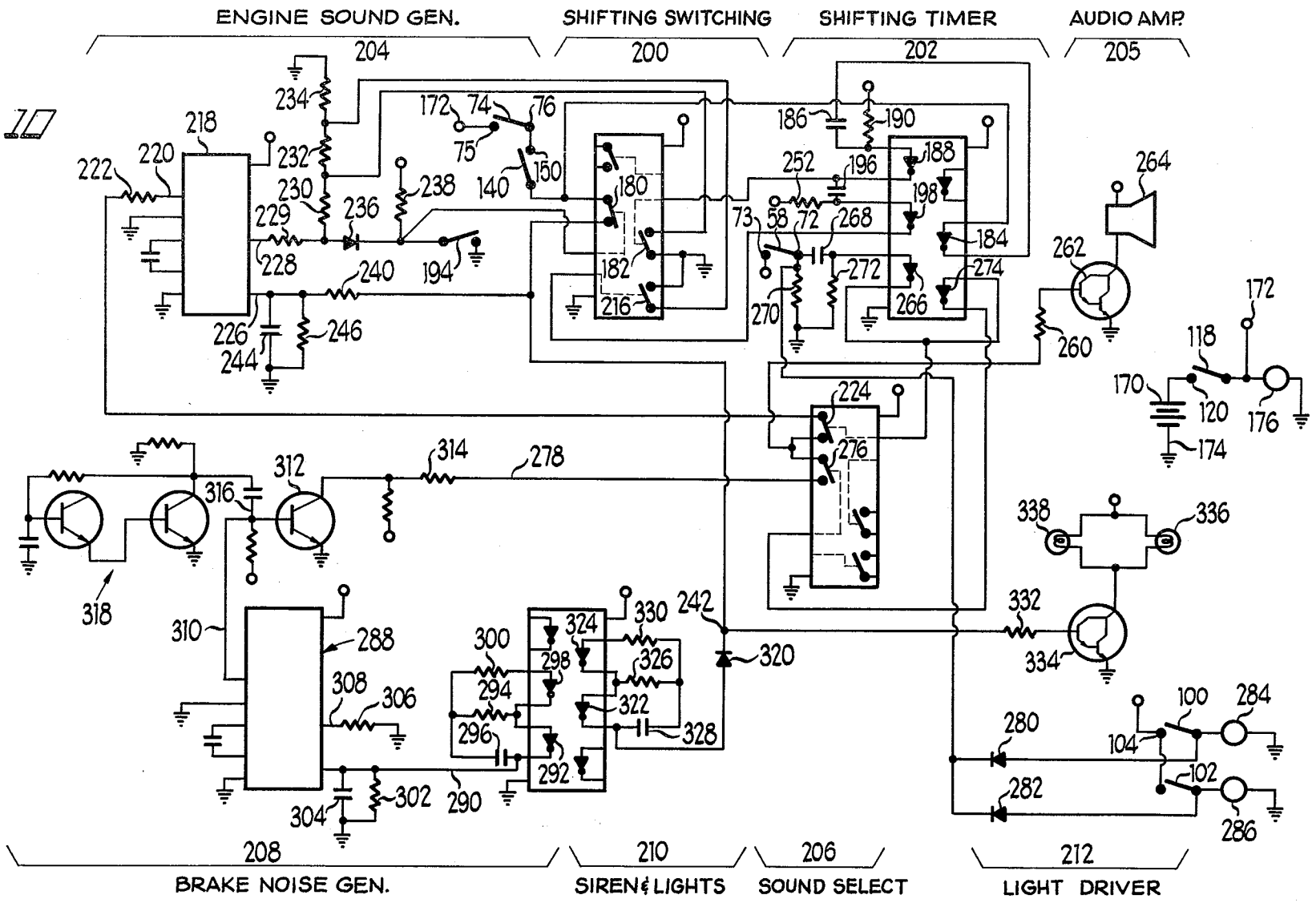
FIG. 10 is an electrical schematic and block diagram representation of the instrumentation and control arrangements of the present invention of FIGS. 1–9.

Considering now the electrical control arrangement and circuitry of the simulated vehicle instrumentation and control apparatus 10 to actuate the various indicators and displays and to provide the aforementioned sound effects and referring now to FIG. 10, the overall control circuitry is energized by a battery source 170 including one or more battery cells resulting in a suitable supply source such as 9 or 12 VDC for example. The battery 170 is arranged to provide a switched reference supply or B+ 172 with respect to a ground reference potential 174 through the ignition switch contacts 118, 120 upon operation of the ignition switch 20. A "GO" illumination source 176 is connected between the switched reference supply 172 and the ground reference 174 to actuate the "GO" indicator 30 upon operation of the ignition switch 20.

A shifting switching circuit generally designated 200 utilizes the accelerator switch contacts 74, 75 and 76 and the drive-park switch contacts 140, 150 to control the simulated engine sounds and shifting sounds during operation through a shifting timer circuit generally designated 202 and an engine sound generating circuit designated 204.

Upon operation of the accelerator pedal control 28 and the transmission gear shift selector control 18 to the drive position, the shifting switching circuit 200 enables the shifting timer circuit 202 and in combination the circuits 200, 202 control the output frequency of an engine sound generator circuit 204 to simulate the engine sounds. The output of the engine sound generator circuit 204 drives an audio amplifier circuit 205.

The output of the engine sound generator circuit 204 is selectively coupled to the audio amplifier 205 through a sound select circuit 206. The sound select circuit 206 also selectively couples various other audio signals for sound simulation effects to the audio amplifier 205 under the control of the brake switch contacts 72, 73, 58 of the brake pedal control 26 and the steering wheel switch contacts 102, 104, 100 of the steering wheel 12. The brake noise generator circuit 208 is selectively coupled to the audio amplifier 205 through the sound select circuit 206 for simulated braking and crash noises. In specific embodiments, a siren sound effect and flashing lights are provided; the flashing lights being mounted on the top of the instrument panel and dashboard housing section 14. The flashing lights in a light driver circuit 212 are controlled by a siren and light circuit 210 and the vehicle apparatus 10 utilizes the engine sound generator circuit 204 to generate a simulated siren sound effect through the audio amplifier circuit 205. A siren and flashing light control switch 194 is provided on the vehicle apparatus 10 to initiate operation of the siren sound effect and the flashing lights as will be explained in detail hereinafter.

Considering now the details of the engine sound generator circuit 204, a voltage controlled oscillator stage (VCO) 218 is controlled by the shifting switching circuit 200 and the switching timer circuit 202 to produce a steadily increasing frequency in a different frequency range for each of the simulated gears of operation. The output 220 of the VCO stage 218 is connected through a series resistor 222 to an input of a bilateral switch 224. When the bilateral switch 224 is operated over a control line, the output of the VCO stage 218 is passed through the bilateral switch 224 path to the input of the audio amplifier circuit 205.

The VCO 218 includes a first variable frequency control line input 226 utilized to provide the increasing variation in the frequency output of the VCO 218 and a second frequency control line 228 input utilized to control the range of frequency operation. The frequency range control line 228 is connected through three series, gear-range resistors 230, 232 and 234 to the ground reference 174. The range frequency control line 228 is also connected through the series combination of a resistor 229, a diode 236, arranged anode to cathode, and a resistor 238 to the switched reference supply 172. In the specific embodiment wherein a siren sound and flashing lights are provided, the cathode of the diode 236 is selectively connected through the siren switch 194 to the ground reference 174.

For selecting the various frequency ranges corresponding to simulated transmission gear operation and siren operation if provided, the junction of the resistors 230 and 232 is connected to an input of a bilateral switch 182. Further, the junction of the resistors 232 and 234 is connected to a bilateral switch at output of a bilateral switch 216. The cathode of the diode 236 is also connected to a bilateral switch control line of a bilateral switch 180. The bilateral switch 180 is utilized to selectively control engine sound and siren sound simulation in the specific embodiment where a siren sound effect and flashing lights are provided. The variable frequency control line 226 is connected through a resistor 240 to an output of the bilateral switch 180 and also to an output 242 of the siren and light circuit 210. The parallel combination of a capacitor 244 an a resistor 246 is connected between the ground reference potential 174 and the variable frequency control line input 226.

In operation, the frequency range control line 228 is connected through the resistors 229 and 230 to the ground reference potential 174 upon operation of the bilateral switch 182 to provide simulated engine operation and sound effects in a first or low gear. Similarly, the frequency range control line 228 is connected through the resistors 229, 230 and 232 to the ground reference potential 174 upon operation of the bilateral switch 216 to simulate operation in a second or medium gear. Simulated operation in a third or high gear is provided by connection of the frequency range control line 228 through the series combination of the resistors 229, 230, 232 and 234 to the ground reference 174. When the siren switch 194 is provided, the frequency range control line 228 is connected through the resistor 229, the diode 236 and the siren switch 194 to the ground reference 174 for operation of the VCO stage 218 in a simulated siren frequency range.

The variable frequency control line 226 controls the increasing frequency variation of the output frequency of the oscillator 218 at output 220 in the various frequency ranges of operation as selected on the frequency range control line 228 for either engine sound operation or for siren sound operation.

The engine sound generator circuit 204 is controlled by the shifting switching circuit 200. Specifically, the reference supply voltage 172 is connected through the accelerator switch contacts 74, 75, 76, the drive-park switch contacts 140, 150, the bilateral switch 180 and the resistor 240 to the variable frequency control line 226 upon operation of the accelerator pedal control 28 and the gear shift control 18. With the siren switch 194 closed, where provided, the bilateral switch 180 is deactivated and the output 242 of the siren and light circuit 210 is coupled to the variable frequency control line 26 for simulated siren operation.

Considering now the details of the shifting timer circuit 202 to control selection of the frequency range of operation for the simulated engine sound in the various gears, upon operation of the accelerator pedal control 28 and the gear shift selector 18 to the drive position, the switched reference supply 172 is connected through an inverter gate 184 to a timer arrangement provided by a capacitor 186 and a resistor 190. The ouput of the inverter gate 184 is connected through the capacitor 186 to the input of an inverter gate 188. The resistor 190 is connected between the switched supply reference 172 and the input of the inverter gate 188. The output of the inverter gate 188 is connected to the control line of the bilateral switch 182. The operation of the accelerator pedal control 28 and the gear shift selector 18 in the drive position provides a high level at the output of the inverter gate 188 for a predetermined time interval determined by the component values of the capacitor 186 and the resistor 190 to operate the bilateral switch 182 for the predetermined time interval. Upon operation, the bilateral switch 180 provides a connection between the ground reference 174 and the junction of the resistors 230 and 232 for simulated engine sound in a first gear frequency range. During the predetermined time interval the VCO stage 218 generates a steadily increasing frequency in the first gear frequency range at the output 220.

After the predetermined time interval determined by the capacitor 186 and the resistor 190, the inverter 188 outputs a low level signal opening the path of the bilateral switch 182. At this point, the high to low transistion is coupled through a timer arrangement to the input of an inverter gate 198. Specifically, the output of the inverter gate 188 is connected through a capacitor 196 to the input of the inverter gate 198. A resistor 252 is connected between the switched reference supply 172 and the input of the inverter gate 198. The high to low transistion at the output of the inverter gate 188 is transferred through the capacitor 196 to produce a high level at the output of the inverter gate 198 to operate the bilateral switch 216 over the control line for a predetermined time interval determined by the component values of the capacitor 196 and the resistor 252. Upon operation of the bilateral switch 216, the ground reference 174 is connected through the resistors 230, 232 and 229 to the frequency range control line 228 for operation of the VCO stage 218 in the second gear. After the predetermined timing interval determined by the capacitor 196 and the resistor 252, the output of the inverter 198 switches to a low level and the bilateral switch 216 is deactuated. Upon deactuation of the switch 216 the resistors 229, 230, 232 and 234 are connected between the ground reference 174 and the frequency range control range 228 and operation in a high or third gear frequency range is obtained for simulated engine sound operation.

Thus, upon operation of the accelerator pedal control 28 and the gear shift selector control 18 in the drive position (with the ignition switch 20 in the "ON" position) simulated vehicle engine sound operation is obtained to simulate shifting between gears and an increasing engine RPM operation in each of the gears.

The output 220 of the VCO stage 218 is coupled through a resistor 222 and the actuated bilateral switch 224 to the audio amplifier stage 205. The bilateral switch contact is connected through a series resistor 260 to the base of an NPN darlington pair, driver transistor arrangement 262. The emitter of the darlington pair 262 is connected to the ground reference 174 and the colleddtor of the transistor pair 262 is connected through a speaker 264 to the switched reference supply 172. The speaker 262 is positioned within the vehicle adjoining panel 22 adjacent the speaker grill array 24.

The bilateral switch 224 of the sound select stage 206 is actuated over the switch control line by the output of an inverter gate 266. The input of the inverter gate 266 is connected through a capacitor 268 to the brake switch terminal 72. The brake switch terminal 73 is connected to the switched reference supply 172. The switch terminal 72 is connected to the ground reference 174 through a resistor 270. The input of the inverter gate 266 is connected through a resistor 272 to the ground reference 174.

Upon operation of the brake pedal control 26, a low to high transistion signal is generated at the input of the inverter gate 266 for a predetermined time interval determined by the component value of the capacitor 268 and the resistor 272. Thus, the output of the inverter 266 is a low level signal for a predetermined time interval and deactuates the bilateral switch 224 over the control line during the predetermined time interval. The output of the inverter gate 266 is connected through an inverter gate 274 to a control line of a bilateral switch 276. One side of the bilateral switch path is connected through the resistor 260 to the audio amplifier transistor pair 262.

Upon operation of the brake pedal control 26, the output of the inverter 274 is a high level to actuate the bilateral switch 276 for a predetermined time interval. The other side of the switch path is connected to an output 278 of the brake noise generator circuit 208. During operation of the brake pedal control 26, the output of the brake noise generator circuit 278 is connected through the actuated bilateral switch 276 to the audio amplifier 205 and transmitted through speaker 264 for the predetermined time interval at the output of the inverter gate 274 while the output from the VCO stage 218 is disconnected from the audio amplifier circuit 205 by means of the deactuated bilateral switch 224.

The left steering wheel switch contact 100 and the right steering switch contact 102 are also connected through the capacitor 268 to the input of the inverter gate 266 through respective diodes 280 and 282 arranged in anode to cathode fashion. The fixed steering switch contact 104 is connected to the switched reference supply line 172. Thus when the steering wheel 12 is turned a predetermined degree of rotation to the right or left of center, the brake noise generator circuit output 278 is connected to the audio amplifier 205 to generate the simulated braking or crash noise through the speaker 264.

The left steering switch contact 100 is connected through a left crash illumination source 284 to the ground reference 174 and the right switch contact 102 is connected through a right crash illumination source 286 to the ground reference 174. The left crash illumination source 284 and the right crash illumination source 286 are positioned behind the left crash indicator 32 and the right crash indicator 34 respectively. Thus, the respective crash illumination sources 284, 286 are actuated upon contact of the respective steering switch contacts 100 or 102 with the switch contact 104.

Concerning now the details of the brake noise generator circuit 108, a voltage controlled oscillator (VCO) stage 288 is controlled over a variable frequency control line 290 connected to the output of an inverter gate 292. The input of the inverter gate 292 is connected through the series combination of a resistor 294 and a capacitor 296 to the frequency control line 290. The input of the inverter gate 292 is also connected to the output of an inverter gate 298. The input of the inverter gate 298 is connected through a resistor 300 to the junction of the resistor 294 and the capacitor 296. The inverter gates 292, 298 and the resistors 294, 300 and the capacitor 296 provide a variable freuqency control input to the VCO stage 288 in combination with a resistor 302 and a capacitor 304 each connected between the frequency control line 290 and the ground reference 174.

The range of frequency operation of the VCO stage 288 is determined by a resistor 306 connected between the frequency range selection line 308 and the ground reference 174. The output 310 of the VCO stage 288 is connected to the base of an NPN transistor 312. The emitter of the transistor 312 is connected to the ground reference 174 and the collector of the transistor 312 is connected through a resistor 314 to the output 278 of the brake noise generator. Also connected to the base of the transistor 312 is the output 316 of a transistor oscillator stage generally designated 318. The transistor oscillator stage 318 functions as a white noise generator and the transistor 312 at the base sums or combines the varying output frequency at 310 of the voltage control oscillator stage 288 and the output 316 of the white noise generator stage 318 to simulate an overall braking or crash sound effect.

Considering the details of a specific embodiment wherein a siren sound effect and flashing lights are provided, the siren and lights control circuit 210 includes a diode 320 having a cathode lead connected to the output 242 of the siren and lights control circuit 210 and an anode lead connected to the output of an inverter gate 322. The input of the inverter gate 322 is connected to the output of an inverter gate 324. The input of the inverter gate 322 is also connected to the anode of the diode 320 through the series combination of a resistor 326 and a capacitor 328. The input of the inverter gate 324 is connected through a resistor 330 to the junction of the resistor 326 and the capacitor 328. The inverter gates 322, 324 and the resistors 330, 326 along with the capacitor 328 provide a variable frequency output through the diode 320 to the output 242 that simulates the varying frequency operation of a siren.

The output 242 is connected through the resistor 240 to the variable frequency control line 246 of the VCO stage 218 of the engine sound generator stage 204 to control the VCO stage 218 to output a simulated siren signal at 220. With the siren switch 194 actuated, a siren frequency range of operation is selected on the frequency range control line 228 through the diode 236, the resistor 229 and the siren switch 194. Further, operation of the siren switch 194 deactuates the bilateral switch 180 to prevent the switched reference supply 172 from being applied to the variable frequency control line 226 when the accelerator pedal control 28 and the gear shift selector 18 are operated.

The output 242 of the siren and lights control circuit 210 is also connected through a resistor 332 to the base of an NPN darlington transistor pair 334. The emitter of the darlington transistor pair 334 is connected to the ground reference 174 and the collector of the darlington transistor 334 is connected through the parallel combination of two emergency lights 336, 338 to the switched reference supply 172. The emergency lights 336 and 338 exhibit electrical characteristics to provide alternate flashing or actuation of each of the lights 336, 338 when placed in circuit by the siren and light circuit 210 through the transistor 334.

Considering the specific embodiment where a manual transmission gear selector control 18 is provided, the control circuitry of FIG. 10 including the shifting switching circuit 200 and the shifting timer circuit 202 are arranged to selectively actuate the indicators 38, 40 and 42 to instruct the operator as to the required shifting to be accomplished by the gear shift selector 18. Thus, upon operation of the ignition switch 20, the control circuit of the vehicle apparatus 10 actuates the first gear indicator 38 suggesting a shift from the neutral position of the gear shift rod 126 from the neutral position to the first gear position. After the operator shifts to the first gear and after a predetermined time interval controlled by the shifting timer stage 202, the control circuitry actuates the second gear indicator 40 suggesting a shift by the operator from the first gear to the second gear. Similarly, after the operator shifts to the second gear, the shifting timer stage 202 actuates the third gear indicator 42 after a predetermined time interval. In one specific embodiment, the operator is required to deactuate the accelerator pedal control 28 during shifts.

In one specific implementation of the control circuit of FIG. 10, the following CMOS integrated circuit devices available from RCA have been found suitable for the various identified stages although the listed devices should not be interpreted in any limiting sense:

| DEVICE | DEVICE TYPE |
|---|---|
| VCO's 218 and 288 | 4046 |
| INVERTERS 188, 198, 184, 274 | 4584 (six gates per device) |

-continued

| DEVICE | DEVICE TYPE |
|---|---|
| 266, 292, 298, 322 and 324 | |
| SWITCHES 180, 182, 216, 224 and 276 | 4066 (four switches per device) |

In a specific embodiment, the overall functions of the control circuitry of FIG. 10, is implemented on a single integrated circuit device chip except for the identified controls, illumination sources, etc.

The foregoing detailed description has been given for clearness of understanding only and no unnecessary limitations should be understood therefrom as some modifications will be obvious to those skilled in the art.

We claim:

1. A toy vehicle instrumentation and control apparatus comprising:

a toy vehicle instrumentation panel and control housing;

operator actuated control means attached to said housing and being positionable to various operating positions;

means adjacent said operator control means for sensing the operative positions of said operator actuator control means; and means responsive to said operative position sensing means for automatically generating at least two increasing frequency sound effects one after the other, each for a predetermined time duration corresponding to engine operation in at least two respective forward drive modes in response to predetermined states of said sensing means corresponding to predetermined operative positions of said operator actuated control means.

2. The vehicle instrumentation and control apparatus of claim 1 further comprising indicator means and means responsive to said sensing means for selectively actuating said indicator means in response to predetermined states of said sensing means.

3. The vehicle instrumentation and control apparatus of claim 1 or 2 wherein said operator actuated control means comprises a rotatable steering wheel and said sensing means comprises steering means for sensing positioning of said steering wheel beyond a predetermined rotation in either direction.

4. The vehicle instrumentation and control apparatus of claim 3 wherein said generating means comprises means responsive to said steering wheel sensing means for generating a crash sound effect.

5. The vehicle instrumentation and control apparatus of claim 1 or 2 wherein said operator actuated control means comprises gear shift selector means being positionable between a park or neutral position and at least one forward drive position.

6. The vehicle instrumentation and control apparatus of claim 1 or 2 wherein said operator actuated control means comprises accelerator pedal control means being positionable between at least an operative and an inoperative position and said sensing means comprises accelerator sensing means for sensing the operative and inoperative positions of said accelerator pedal control means.

7. The vehicle instrumentation and control apparatus of claim 1 or 2 wherein said operator actuated control means comprises brake pedal control means being positionable between at least an inoperative and an operative position and said sensing means comprises means for sensing the operative position of said brake pedal control means.

8. The vehicle instrumentation and control apparatus of claim 9 wherein said generating means comprises means responsive to said brake sensing means for generating a braking sound effect in response to operation of said brake pedal control means.

9. The vehicle instrumentation and control apparatus of claim 1 or 2 wherein said operator actuated control means comprises ignition switch control means being operable between at least an on and an off position and said sensing means comprising means for sensing operation of said ignition switch control means.

10. The vehicle instrumentation and control apparatus of claim 11 further comprising means responsive to said ignition switch sensing means for actuating a status indicator representing the ready state for subsequent vehicle operation.

* * * * *